United States Patent [19]

Gotoh

[11] 4,063,303

[45] Dec. 13, 1977

[54] STOP-MOTION APPARATUS OF WEAVING LOOMS

[76] Inventor: Miyuki Gotoh, No. 4-48-21, Midori-cho, Tokorozawa, Japan

[21] Appl. No.: 678,668

[22] Filed: Apr. 20, 1976

[30] Foreign Application Priority Data

May 20, 1975 Japan ..... 50-59221

[51] Int. Cl.[2] ..... H01H 47/02

[52] U.S. Cl. ..... 361/170; 340/259; 361/194

[58] Field of Search ..... 317/137, 138, 139, 140; 340/259, 415; 66/157, 163, 166; 139/336, 353, 370 R; 361/166, 168, 170, 171, 189, 191, 194

[56] References Cited

U.S. PATENT DOCUMENTS

| | | | |
|---|---|---|---|
| 3,530,689 | 9/1970 | Yarbough | 66/157 |
| 3,636,411 | 1/1972 | Bulloch | 317/137 |
| 3,725,911 | 4/1973 | Cook et al. | 340/259 |
| 3,911,969 | 10/1975 | Rydborn | 139/370 R |

*Primary Examiner*—Gerald Goldberg

*Attorney, Agent, or Firm*—Robert E. Burns; Emmanuel J. Lobato; Bruce L. Adams

[57] ABSTRACT

A signal is generated indicating a defect in a woven fabric and applied to a counting circuit stopping the loom which starts at a normal operating condition after correction when a normal length of fabric has been made in response to a reset signal.

7 Claims, 9 Drawing Figures

STOP-MOTION APPARATUS OF WEAVING LOOMS

This invention generally relates to stop-motion apparatus of a weaving loom, and more particularly to apparatus for automatical stop-motion of a weaving loom when an improper insertion or threading of a weft yarn is detected during the operation of the loom.

I have already proposed stop-motion apparatus of a weaving loom wherein an abnormal signal is generated when a weft yarn is improperly inserted, and a stop signal for stopping the weaving loom is generated only when a predetermined number of the abnormal signals is generated in weaving a preset unit length of the woven fabric. When such stop-motion apparatus is used it is possible to decrease the number of the improperly inserted weft yarns below a predetermined limit for each unit length of the woven fabric, but for a standard or reference length of the woven fabric (for example, 24 yards) which is a predetermined multiple of said unit length the total number of the improperly inserted weft yarns becomes larger than a limit permissible to the entire length of the fabric, thereby degrading the quality thereof.

It is an object of this invention to provide an improved stop-motion apparatus of a weaving loom capable of decreasing the number of the defects in the woven fabric caused by improper insertion of weft yarns not only for a unit length but also for a reference or standard length of the woven fabric.

Another object of this invention is to provide an improved stop-motion apparatus of a loom capable of reducing the number of defects below a predetermined limit not only for a unit length but also for a reference length of the woven fabric without the necessity of stopping the weaving loom each time an abnormal signal is produced, thereby increasing the efficiency of the operation of the loom and improving the quality of the woven fabric.

According to this invention, these and other objects can be accomplished by providing stop-motion apparatus of a weaving loom of the type wherein the output of an abnormal signal generator is applied to a counting circuit, said generator generating the abnormal signal when an improper insertion of a weft yarn is detected, the counting circuit being reset by the reset pulse generated by a reset circuit when the weaving operation of a unit length is completed, the counting circuit producing an output when the number of the abnormal signals applied to the counting circuit exceeds a predetermined limit while the unit length is being woven, and the output is utilized to open the circuit of the driving means of the weaving loom, characterized in that there are provided a second counting circuit connected in parallel with the first mentioned counting circuit, means to apply the output from the abnormal signal generator to the second counting circuit, a second reset circuit which generates a second pulse each time a reference length of the fabric equal to a multiple of the unit length is woven, means to apply the second pulse to the second counting circuit for periodically resetting the same, means for causing the second counting circuit to produce an output when the number of the abnormal signals applied to the second counting circuit from the abnormal signal generator exceeds a second predetermined limit during an interval between the second pulses, and means responsive to the output from the second counting circuit for opening the circuit of the loom driving means.

According to a preferred embodiment of this invention the stop-motion apparatus of a weaving loom comprises an abnormal signal generator which detects an improper insertion or threading of a weft yarn for generating an abnormal pulse signal, first and second counting circuits which count the abnormal signals for generating outputs when these counts exceed predetermined numbers, a first reset signal generator for generating and applying its output to the first counting circuit when a predetermined unit length of the fabric has been woven thereby resetting the count of the first counting circuit to 0, a second reset signal generator for periodically generating and applying its output to the second counting circuit each time a predetermined reference or standard length of the fabric has been woven thereby resetting the count of the second counting circuit to 0, a switching circuit for opening and closing the circuit of the driving means of the weaving loom, and a restarting switch for the driving means of the weaving loom. Thus, when either one or both of the first and second counting circuits counts the abnormal signals the number exceeding a predetermined limit during an interval in which the unit length of the fabric is woven, and the first counting circuit produces an output, and during one period of the periodically generated output of the second counting circuit, the output from the counting circuits or the abnormal signal from the abnormal signal generator is applied to the switching circuit for opening the circuit of the driving means of the weaving loom. While the weaving loom is stopped, the improperly inserted weft yarn is corrected or a cause of the improper insertion of the weft yarn is removed and the restarting switch is operated to restart the weaving loom, thus obviating the difficulty described above. In this case the first counting circuit comprises an addition circuit, a reset circuit and a subtraction circuit and operates to produce a pulse output when it receives inputs of the number exceeding a predetermined number. Furthermore, the first counting circuit resets its count to zero or reduces its count by a predetermined number when it receives a reset pulse. The second counting circuit is identical to the first counting circuit except it does not include the subtraction circuit.

Figure 1:
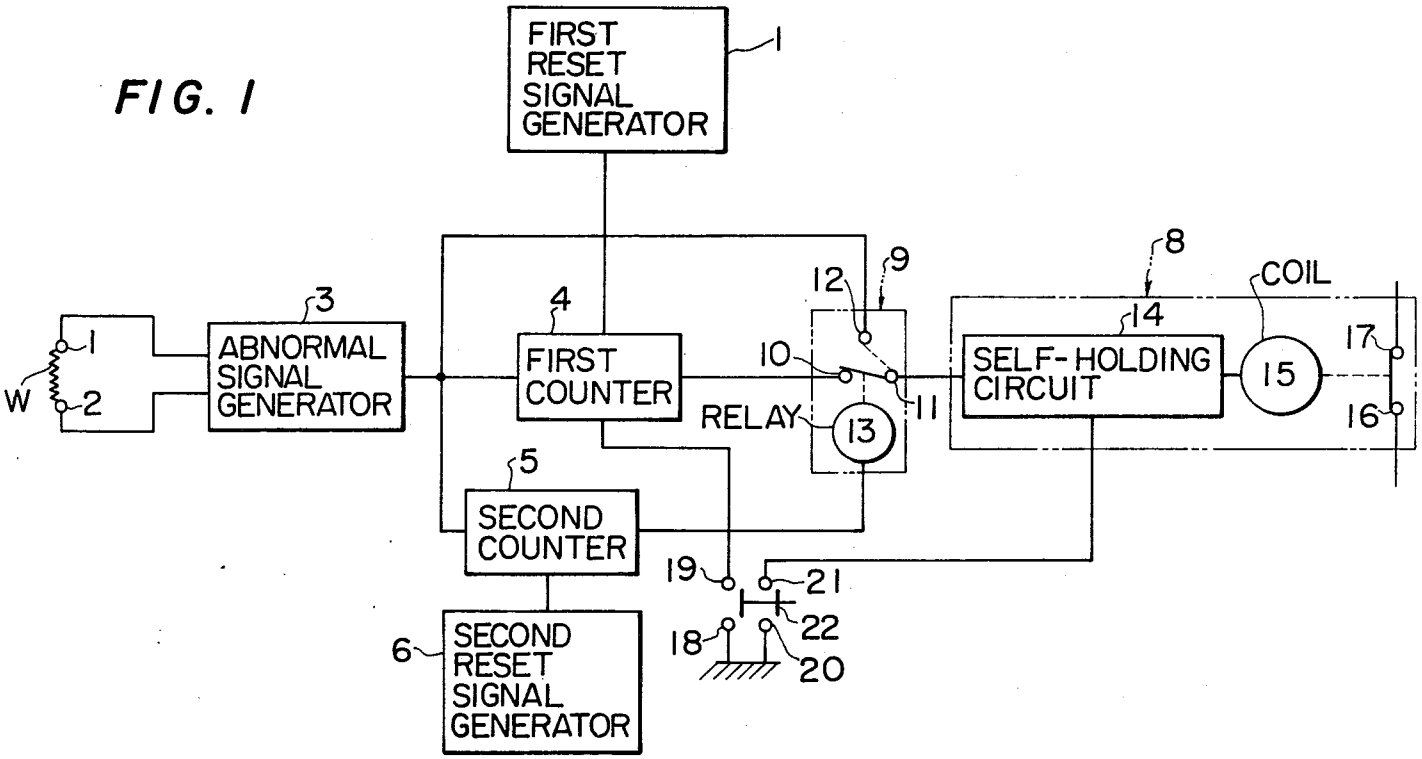
FIG. 1 is a block diagram showing and preferred embodiment of the stop-motion apparatus of the invention.

A preferred embodiment of this invention illustrated in FIG. 1 comprises two electrodes 1 and 2 provided for detecting the presence or absence of a weft yarn W and insulatedly secured to a beater, not shown. These electrodes are connected to input terminals of an abnormal signal generator 3 which is constructed to generate an abnormal signal when a weft yarn W is not properly inserted so that no current flows through the weft yarn W between electrodes 1 and 2. The output from the abnormal signal generator 3 is applied to the input of a first counting circuit 4 which counts the number of the abnormal signals for generating a pulse signal when the number of the abnormal signals exceeds a preset limit (which is hereinafter termed a "unit limit") and to the input of a second counting circuit 5 which also counts the number of the abnormal signals for continuously generating a signal when the number of the abnormal signals reaches a limit (which is hereinafter termed a "reference limit") different from the unit limit. Generation of the signal from the second counting circuit 5 is terminated when it is reset. The output from the first counting circuit 4 is also applied to a stationary contact of a switching circuit 9 which is constructed to bridge stationary contacts 11 and 12 when its relay coil 13 is energized but bridge contacts 10 and 11 when the relay coil 13 is de-energized. The output of the first counting circuit 4 is connected to the stationary contact 10 of the switching circuit 9 and the reset terminal of the first counting circuit 4 is connected to a first reset signal generator 7 which is constructed to periodically generate a reset signal. The subtracting terminal of the first counting circuit 4 connected to one terminal 19 of two grounding terminals 19 and 18 of a restarting interlocked push button 22. The terminal 18 is grounded so that when contacts 18 and 19 are bridged by the push button 22 at the time of restarting, the count of the first counting circuit 4 is decreased by one. The other contacts 20 and 21 are arranged to be bridged by the push button 22. The reset terminal of the second counting circuit 5 is connected to receive a reset signal periodically generated by a second reset signal generator 6. The output of the second counting circuit 5 is connected to the relay coil 13 of the switching circuit 9 so that when the second counting circuit 5 produces no output, the output from the first counting circuit 4 is applied to the self-holding circuit 14 of a second switching circuit 8 through contacts 10 and 11, whereas when the second counting circuit 5 produces an output, coil 13 is energized to apply the output from the abnormal signal generator 3 to the self-holding circuit 14 via contacts 12 and 11. The second switching circuit 8 comprises the self-holding circuit 14, an energizing coil 15 energized thereby and contacts 16 and 17 connected in the circuit of a driving means for the weaving loom. The self-holding circuit 14 is constructed to continuously generate a signal when it receives a pulse signal whereby the exciting coil 15 is energized to disconnect contacts 16 and 17 thus stopping the weaving loom. When push button 22 bridges contacts 20 and 21 to ground the self-holding circuit 14, the self-holding circuit 14 is interrupted to de-energize coil 15 whereby contacts 16 and 17 are interconnected to restart the weaving loom. If desired, a delay circuit, not shown, may be included between the second counting circuit 5 and the relay coil 13 so that the connection is switched between contacts 10 and 11 and between contacts 11 and 12 in response to the output from the second counting circuit 5 which is produced when the number of the abnormal signals reaches the reference limit. When the number of the abnormal signals exceeds the unit limit so that the first counting circuit 4 produces an output the output is applied to the switching circuit 8.

It is now assumed that the number of improperly inserted weft yarns or defects of the woven fabric per unit length of the woven fabric should be limited to be less than 2 and that the number of the defects per reference length of the woven fabric should be limited to be less than 7. The operation of the embodiment under these conditions is as follows. To simplify the description, it is now assumed that one unit length corresponds to 1/7 of the reference length. As shown in FIG. 2A, the first reset signal generator 7 produces periodic pulses **7*a* through 7*h* each time the unit length of the fabric is woven, whereas the second reset signal generator 6 produces reset pulses 6*a* and 6*h* each time the reference length of the fabric is woven as shown in FIG. 2F. It is now supposed that the abnormal signal generator 3 produces abnormal signals 3*a* and 3*b* between pulses 7*a* and 7*b*, abnormal signals 3*c* and 3*d* between pulses 7*c* and 7*d*, abnormal signals 3*f* and 3*g* between pulses 7*e* and 7*f*, abnormal signal 3*h* between pulses 7*f* and 7*g* and abnormal signal 3*i* between pulses 7*g* and 7*h*, as shown in FIG. 2B. The unit limit of the first counting circuit 4 is set to 2 and the reference limit of the second counting circuit 5 is set to 7. Considering the abnormal signal 3*g*, this signal is the seventh abnormal with respect to the signal 6*a* generated by the second reset signal generator 6 indicating that the number of the defects approaches the reference limit. Under these conditions, the second counting circuit 5 produces a continuous output signal 5*a*, as shown in FIG. 2D whereby relay coil 13 is energized to disconnect the connection between stationary contacts 10 and 11 and interconnect stationary contacts 11 and 12. Accordingly, only when any one of signals 3*a* through 3*g* exceeds the unit limit of 2, in other words only when abnormal signal 3*e* is produced the first counting circuit 4 produces output signal 4*a*, as shown in FIG. 2C, which is applied to switching circuit 8 as an input signal 8*a*, as shown in FIG. 2E, via contact 10 and 11. This input signal 8*a* is applied to th self-holding circuit 14 so that the exciting coil 15 will be energized until the self-holding circuit 14 is broken by the restarting interlocked push button switch 22, thus opening normally closed contacts 16 and 17 to stop the operation of the weaving loom. With regard to abnormal signals 3*h* and 3*i*, since contacts 11 and 12 are interconnected by the movable contact, these signals are directly applied to the switching circuit 8 as input signals 8*b* and 8*c* (see FIG. 2E) via contacts 11 and 12 thus stopping the weaving loom. To restart the loom which has been stopped by any one of the input signals 8*a*, 8*b* and 8*c*, the restarting interlocked push button switch 22 is depressed to interconnect contacts 20 and 21. Then the self-holding circuit 14 is grounded to remove the self-holding effect so that the exciting coil 15 is de-energized to close the normally closed contacts 16 and 17. Thus, the loom is restarted. At the same time, contacts 18 and 19 of the push button switch 22 are bridged thus grounding the subtraction circuit of the first counting circuit 4. Accordingly, the count of this counting circuit is decreased by one. Where the weaving loom is stopped in accordance with abnormal signal 3*e*, the count of the first counting circuit 4 will be reduced to 2 from 3 upon restarting of the loom and the counting circuit 4 is set to a waiting condition for producing an output signal when it receives the next abnormal signal until the next reset signal 7*d* is produced. The reset signals 7*a*, 7*b* and 7*h* from the first reset signal generator 7 operates to reduce the count of the first counting circuit 4 to zero whereas the reset signals produced by the second reset signal generator 6 operate to reduce the count of the second counting circuit 5 to zero, thus stopping its output signal 5*a***.

With this construction, stop-motion of the weaving loom will not operate each time an abnormal signal is produced. Furthermore, it is possible to hold the stop-motion inoperative when the number of defects is below the prescribed limit not only for the unit length but also for the reference length of the woven fabric, thus increasing the operating efficiency of the loom and improving the quality of the woven fabric.

Figure 3:
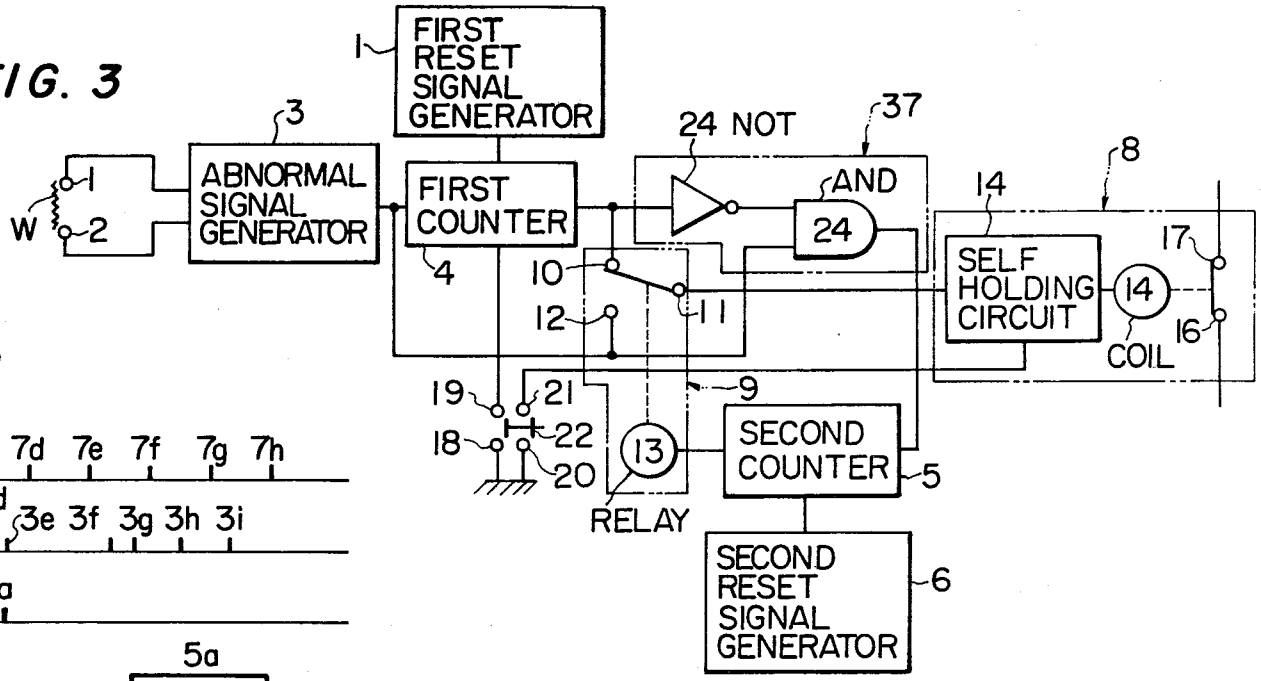
FIGS. 3 and 4 are block diagrams showing other preferred embodiments of this invention.

A second preferred embodiment shown in FIG. 3 is different from the first embodiment described above in that a subtraction circuit 37 is inserted between the abnormal signal generator 3 and the second counting circuit 5. The subtraction circuit 37 comprises an NOT gate circuit 23 and an AND gate circuit 24 and is constructed such that concurrently with the application of the output signal from the first counting circuit 4 to the switching circuit 9, this output is also applied to one input of the AND gate circuit 24 via the NOT gate circuit 23. Furthermore, the output from the abnormal signal generator 3 is applied to the other input of the AND gate circuit 24 and the output thereof is applied to the second counting circuit 5.

Figure 2:
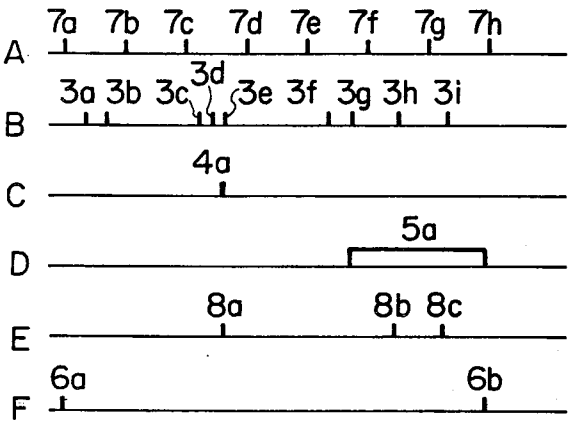
FIGS. 2A through 2F show waveforms useful to explain the operation of the preferred embodiment shown in FIG. 1.

Consequently, so long as the abnormal signals number less than the unit limit number are applied to the first counting circuit 4 from the abnormal signal generator 3, the first counting circuit 4 does not produce any output or produces a 0 signal. This signal is inverted by the NOT gate circuit 23 and applied to one input of the AND gate circuit 24 as a positive signal. At the same time, a positive signal from the abnormal signal generator 3 is applied to the other input of the AND gate circuit 24 so that the AND gate circuit 24 produces a pulse signal which is applied to the second counting circuit 5 and counted thereby. When the number of the abnormal signals from the abnormal signal generator exceeds the unit limit the first counting circuit produces a positive pulse which stops the operation of the weaving loom in a manner described above. This positive pulse is inverted by the NOT gate circuit 23 into a 0 signal which is applied to one input of the AND gate circuit 24. The abnormal signal from the abnormal signal generator 3 is applied to the other input of the AND gate circuit 24 as a positive pulse. However, since the output at this time from the NOT gate circuit 23 is 0, the AND gate circuit 24 will not produce an output. In other words, the signal from the abnormal signal generator 3 is cancelled by the output signal from the first counting circuit 4 by the action of the subtraction circuit 37. Accordingly, the count of the second counting circuit 5 representing the number of the abnormal signals is not increased. Assuming the same unit limit and the same reference unit as in the first embodiment, and by using FIG. 2, the operation of the second embodiment shown in FIG. 3 can be explained as follows. More particularly, since abnormal signal **3*e* (FIG. 2B) is a signal beyond the unit limit the first counting circuit 4 produces an output 4*a* (FIG. 2C). Accordingly, signal 3*e* is cancelled by the subtraction circuit 37 so that signal 3*e* will not be applied to the second counting circuit 5. Under these conditions, the second counting circuit 5 does not reach the reference limit until abnormal signal 3*g* but reaches the reference limit only at the abnormal signal 3*h* thus producing an output signal 5*a* (FIG. 2D). With the second embodiment, as the number of the defects of the woven fabric is made to coincide with the number of the abnormal signals applied to the second counting circuit 5** the weaving loom will not be stopped too frequently whereby it is possible not only to improve the operating efficiency of the loom but also to produce woven fabrics of a high quality.

Figure 4:
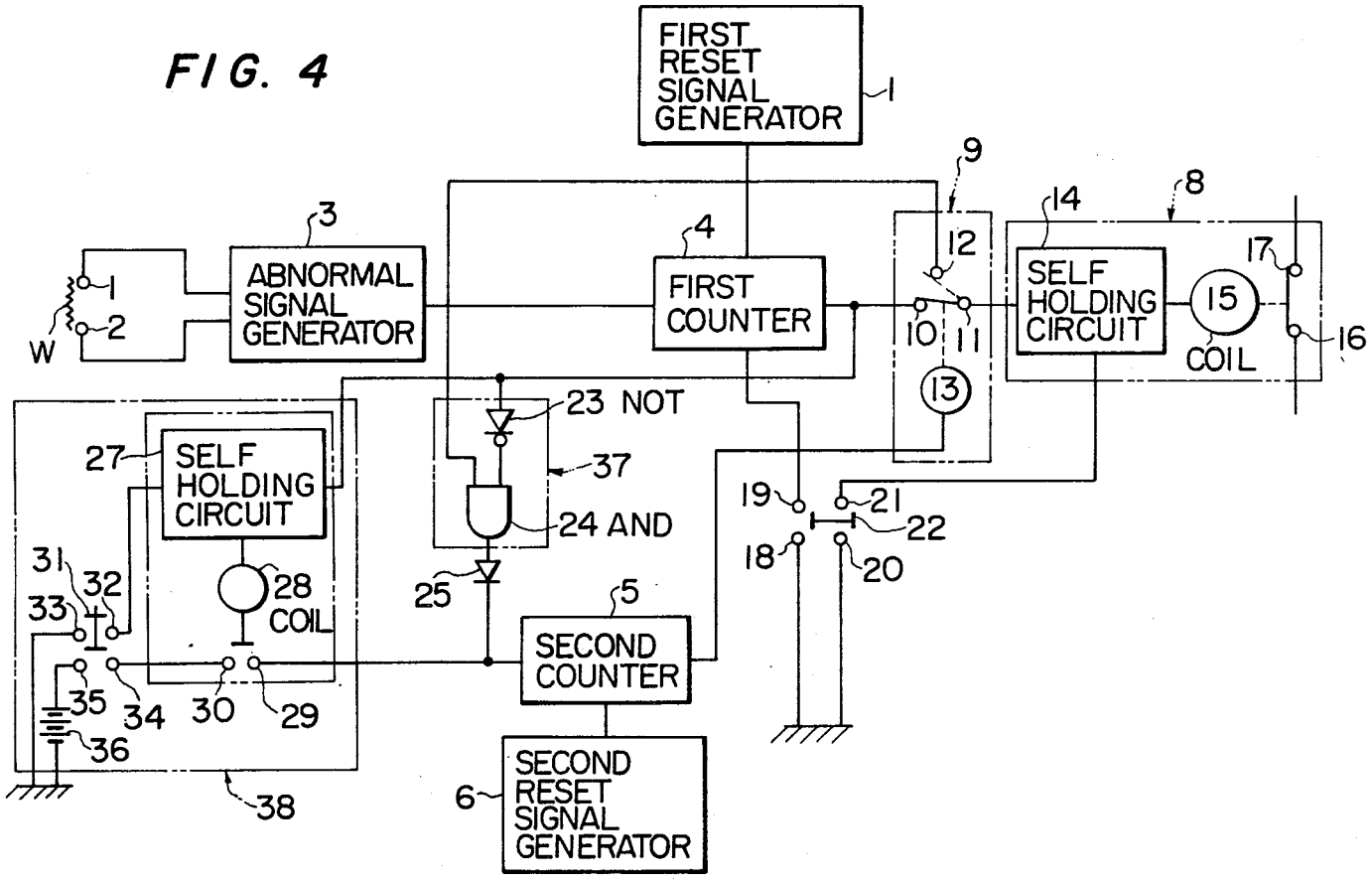

FIG. 4 shows a block diagram of a third preferred embodiment of this invention. The third embodiment is similar to the second embodiment shown in FIG. 3 but differs therefrom in the following points: more particularly, a diode 25 which is poled to pass the signal from the subtraction circuit 37 is connected between the input terminal of the second counting circuit 5 and the subtraction circuit 37. Furthermore, an addition signal generator 38 comprising a source 36, a push button switch 31 and a switching circuit 26 connected to the input terminal of the second counting circuit 5. The push button switch 31 is interlinked with the switching circuit 26. The switching circuit 26 comprises a self-holding circuit 27, an exciting coil 28 and contacts 29 and 30 of which the contact 29 is connected to the input terminal of the second counting circuit 5. On the other hand, contact 30 is connected to the positive pole of source 36 via the contacts 34 and 35 of the push button switch 31. One terminal of the self-holding circuit 27 is connected to the output of the first counting circuit 4, and the other terminal is connected to be grounded through the contacts 32 and 33 of the push button switch 31. Consequently, when the first counting circuit 4 produces a stop-motion signal, this signal is applied to the switching circuit 9 and to the subtraction circuit 37 in the same manner as in the second embodiment. Furthermore, this stop-motion signal is applied to the self-holding circuit 27 of the switching circuit 26. Then, the exciting coil 28 is energized to bridge contacts 29 and 30. If desired, a delay circuit, not shown, may be connected between contact 32 of the push button switch 31 and the self-holding circuit 27 so that when the interlocked push button switch 31 is depressed, the self-holding circuit 27 is disconnected for a predetermined time later than the closure of contacts 34 and 30 thereby opening contacts 29 and 30.

When a defect of the fabric caused by the improper insertion of the weft yarn cannot be over-ridden by the stop-motion of the loom in response to the output signal from the first counting circuit 4, the push button switch 22 is depressed for restarting the weaving loom. In this case, the count of the second counting circuit 5 is automatically decreased by one in the same manner as in the second embodiment. In such a case, however, by the depression of the push button switch 31, the source 36 is connected to the input of the second counting circuit 5 through contacts 34 and 35 of the push button switch 31 and contacts 29 and 30 which have been closed in response to the output from the first counting circuit 4. Thus, an addition signal analogous to the abnormal signal is applied to the input of the second counting circuit 5 from the addition signal generator 38 with the result that count of the second counting circuit 5 that has been decreased by the subtraction circuit 37 restores its original count. Even when the push button switch 31 is depressed twice, since the holding circuit 27 has been interrupted to open contacts 29 and 30 a second addition signal would not be applied to the second counting circuit 5. As a result, when the first counting circuit 4 produces a stop signal, interlocked push button switch 31 is operated, and the count of the second counting circuit 5 is increased by 1. With this construction, when the loom is stopped by the output from the first counting circuit 4 the improper insertion of the weft yarn is corrected so that the defect would not be formed. Then, the count of the second counting circuit 5 is automatically reduced by 1. However, when the improper insertion of the weft yarn is not corrected by operating the push button switch it is possible to accurately coincide the number of the defects and the count of the second counting circuit 5 which represents the number of the abnormal signals. More particularly, in the second and third embodiments, the stop-motion operates in accordance with abnormal signal 3*h* shown in FIG. 2B, and under the assumption that the defect has been corrected the loom is restarted and the count of the second counting circuit 5 is reduced by 1, whereby the second counting circuit 5 produces output 5*a* (see FIG. 2D) only when the abnormal signal 3*h* is reached. Thus, the loom is not stopped by signal 3*h*, but stopped by signal 3*i*. In the third embodiment, if the defect of the woven fabric were not corrected when the loom is stopped, the push button 31 is depressed to increase the count of the second counting circuit 5 by one so that the loom is stopped by signal 3*h*. In this manner, it is possible to accurately coincide the number of the defects and the count of the second counting circuit 5.

Measurements of the unit length and the reference length of the woven fabric can be made directly by measuring the number of revolutions of a friction roller that engages the fabric without any appreciable slip. Alternatively, such measurements can be made by measuring the number of revolutions of a rotating member of the loom or the number of cores used for supplying the weft yarns, or the operating time of the loom. Although in all foregoing embodiments, the unit length of the woven fabric is continuously measured it is also possible to commence the measurement by the abnormal signal generated by the abnormal signal generator 3 in response to the improper insertion of the weft yarns by connecting the abnormal signal generator with the first reset signal generator 7. In this case, if the measurement of the unit length is commenced at the first abnormal signal it is necessary to provide suitable means that nullifies subsequent abnormal signals applied to the first reset signal generator until such measurement is completed. With this method of measuring the unit length of the woven fabric, even when the defects concentrate about a signal generated by the second reset signal generator it is possible to measure the unit length including said signal so that the stop-motion will operate. In the first to third embodiments the connection between contacts 10 and 11 of the switching circuit 9 is opened by the output from the second counting circuit 5. It is also possible to normally interconnect contacts 10 and 11 and to open and close contacts 10 and 11 in response to the presence and absence of the output from the second counting circuit 5.

What is claimed is:

1. In stop-motion apparatus of a weaving loom of the type wherein the output from an abnormal signal generator is applied to a counting circuit, said generator generating the abnormal signal when it detects an improper insertion of a weft yarn, said counting circuit is reset by a reset pulse generated by a reset circuit when the weaving operation of a unit length is completed, said counting circuit produces an output when the number of the abnormal signals applied to the counting circuit exceeds a predetermined limit while said unit length is being woven, and said output is utilized to open the circuit of the driving means of said weaving loom, the improvement which comprises a second counting circuit connected in parallel with said first mentioned counting circuit, means to apply the output from said abnormal signal generator to said second counting circuit, a second reset circuit which generates a second pulse each time a reference length of the fabric equal to a multiple of said unit length is woven, means to apply said second pulse to said second counting circuit for periodically resetting the same, means for causing said second counting circuit to produce an output when the number of the abnormal signals applied to said second counting circuit from said abnormal signal generator exceeds a second predetermined number during an interval between said second pulses, and means responsive to the output from said second counting circuit for opening said circuit of the loom driving means.

2. The stop-motion apparatus according to claim 1 further comprising a subtraction circuit connected between said abnormal signal generator and said second counting circuit cancelling the signal applied to said second counting circuit from said abnormal signal generator in accordance with the output from said first counting circuit.

3. The stop-motion apparatus according to claim 2 further comprising an addition signal generator for increasing the count of said second counting circuit by one.

4. The stop-motion apparatus according to claim 1 wherein said last mentioned means responsive to the output from said second counting circuit comprises a self-holding circuit, a coil energized by said self-holding circuit for opening and closing the circuit of the loom driving circuit, a relay coil energized by the output from said second counting circuit for applying the output from said first counting circuit to said self-holding circuit or for applying the output from said abnormal signal generator directly to said self-holding circuit, and a push button switch for interrupting said self-holding circuit and at the same time for decreasing the count of said first counting circuit.

5. The stop-motion apparatus according to claim 2 wherein said subtraction circuit comprises an NOT gate circuit connected to the output of said first counting circuit, and an AND gate circuit with one input connected to the output of said NOT gate circuit, the other input being connected to the output of said abnormal signal generator, and the output connected to the input of said second counting circuit.

6. The stop-motion apparatus according to claim 2 wherein a diode is connected between said subtraction circuit and said second counting circuit.

7. The stop-motion apparatus according to claim 3 wherein said addition signal generator comprises a source of DC, a self-holding circuit connected between the output of said first counting circuit and the ground through a push button switch, and a relay for counting said source to the input of said second counting circuit through said push button switch.

* * * * *